US006732377B1

(12) United States Patent
Wilkinson

(10) Patent No.: US 6,732,377 B1
(45) Date of Patent: May 11, 2004

(54) HANDLE-GRIP AND SPORT GLOVES

(75) Inventor: Paul Richard Wilkinson, Gerrards Cross (GB)

(73) Assignee: Staygripped Limited, Hempstead (GB)

( * ) Notice: Subject to any disclaimer, the term of this patent is extended or adjusted under 35 U.S.C. 154(b) by 0 days.

(21) Appl. No.: 10/088,973

(22) PCT Filed: Sep. 22, 2000

(86) PCT No.: PCT/GB00/03640

§ 371 (c)(1),
(2), (4) Date: Mar. 25, 2002

(87) PCT Pub. No.: WO01/23046

PCT Pub. Date: Apr. 5, 2001

(30) Foreign Application Priority Data

Sep. 25, 1999 (GB) ..... 9922662

(51) Int. Cl.[7] ..... A41D 19/00
(52) U.S. Cl. ..... 2/161.4; 2/917; 473/205
(58) Field of Search ..... 2/161.1–161.4, 2/161.6, 163, 917; 473/131, 205

(56) References Cited

U.S. PATENT DOCUMENTS

| | | | | |
|---|---|---|---|---|
| 3,368,811 A | * | 2/1968 | Finney | 473/300 |
| 3,532,344 A | | 10/1970 | Masstab | |
| 3,848,874 A | | 11/1974 | Elkins, Jr. | 273/183 B |
| 4,665,565 A | * | 5/1987 | Odom | 2/161.2 |
| 4,691,387 A | * | 9/1987 | Lopez | 2/161.3 |
| 5,156,399 A | * | 10/1992 | Gauer | 473/205 |
| 5,184,827 A | * | 2/1993 | Suttle et al. | 473/205 |
| 5,232,225 A | | 8/1993 | Snyder | 273/187.2 |
| 5,462,280 A | | 10/1995 | Dickerson | 273/187.2 |
| 5,542,126 A | | 8/1996 | Harvanek | 273/26 C |
| 5,704,065 A | | 1/1998 | Feuerhake | 2/161.2 |
| 5,836,828 A | | 11/1998 | Sinton | 473/205 |
| 5,890,228 A | | 4/1999 | Wagner | 2/160 |
| 6,212,687 B1 | * | 4/2001 | Kwon | 2/161.3 |
| 6,279,164 B1 | * | 8/2001 | Martin | 2/161.1 |

FOREIGN PATENT DOCUMENTS

| | | | |
|---|---|---|---|
| DE | 298 04 190 U | 7/1998 | |
| EP | 0 405 655 A1 | 6/1990 | A41D/13/10 |
| GB | 1013381 | 12/1965 | A63B/53/14 |
| GB | 2 080 672 A | 2/1982 | A41D/19/00 |
| GB | 2 200 275 A | 8/1988 | A41D/19/00 |
| GB | 2 313 320 A | 11/1997 | |
| GB | 2 355 413 A | 4/2001 | A63B/53/14 |
| WO | 98/03231 | 1/1998 | A63B/53/14 |
| WO | 01/23046 A1 | 5/2001 | A63B/59/00 |

* cited by examiner

*Primary Examiner*—John J. Calvert
*Assistant Examiner*—Katherine Moran
(74) *Attorney, Agent, or Firm*—Davis & Bujold PLLC

(57) ABSTRACT

Relaxation of grip during a golf stroke is restrained by hook-to-loop adhesion between fabric (5) covering the golf-club handle (3) and fabric elements (11–14) attached to the golfer's gloves (1, 2). The handle-covering fabric (5) has hook-ended threads and is wrapped around the handle (3) directly (or helically (25) FIG. 5). Loop-fabric patches (11, 13) are attached to the tips of the glove-thumbs (15, 21), and loop-fabric elements (12, 14) extend across the palms (16, 22) at the base of the fingers (17–20, 23, 24). Change of grip is signaled by a tearing sound as hook-loop engagement is broken at either glove (1, 2). An alternative pair of gloves ((21, 32), FIGS. 6–10) includes a palm-located fabric element (38) augmenting adhesion of the lower glove (31) with the handle (3), and mutally-adhering fabric elements (34, 39) of opposite thread types for restraining relaxation of the upper glove (32) from where it overlies the lower glove (31).

17 Claims, 4 Drawing Sheets

HANDLE-GRIP AND SPORT GLOVES

FIELD OF THE INVENTION

This invention relates to handle-gripping, and is concerned in this respect with assisting a person in the grip of a handle especially in the context of sports activities.

BACKGROUND OF THE INVENTION

The invention is particularly, though not exclusively, concerned with assisting a golfer to achieve and maintain optimum grip of a golf-club handle, towards improvement of his/her game.

The driving of a golf ball accurately, depends on factors such as the stance of the golfer, how the club is held and how the swing of the club is executed. The golfer's stance and grip of the club are adjusted in the preliminary addressing of the ball. Adjustment is made in particular to ensure that the golfer is able to execute the swing freely and that his/her hands are correctly oriented on the handle of the club in relation both to one another and the club head It often happens, however, that the desired strike is not in the event achieved because the golfer relaxes or changes his/her grip on the club-handle during the swing. The relaxation or change of grip during the swing may easily occur unconsciously or certainly without intention on the part of the golfer, and it is one of the objects of the invention to assist a golfer overcome the problem. More generally, it is an object of the present invention to provide a method of restraining relaxation or change of a person's grip of a handle.

SUMMARY OF THE INVENTION

According to one aspect of the present invention there is provided a method of restraining relaxation or change of a user's grip of a handle, wherein a selectively-releasable fastening is used between the handle and the user's gripping hand or hands, for adhesion between them.

According to another aspect of the invention there is provided, in combination, a handle to be gripped by a user, and a glove to be worn by the user in gripping the handle, wherein relaxation or change of the user's grip of the handle is restrained by a selectively-releasable fastening that provides adhesion between the handle and the glove.

The selectively-releasable fastening in both the method and handle-glove combination of the present invention, may be of the kind that involves adhesion between two fabric elements through selectively-breakable engagement between hook-ended threads of one element and threads of the other. The fastening, which in this case may be of the kind sold under the Registered Trade Mark VELCRO, has advantage in that engagement is readily achieved upon contact, and disengagement requires the exertion of significant force and is normally accompanied by a distinct tearing sound; moreover, the process of engagement and disengagement can be repeated almost indefinitely without loss of effectiveness. With such a fastening arranged to be active between the handle and the one or more gripping hands, engagement can be readily achieved simply and directly in the formation of the desired grip, whereas disengagement requires distinct effort and is commonly accompanied by a tell-tale sound. In these circumstances, and especially because of its fabric form, the fastening need have no obstructive or disruptive effect on the adoption and maintenance of the required grip of the handle.

The two elements may be readily incorporated respectively in the handle and one or more gloves worn by the user, and as such may be active to resist change or relaxation of the gloved hand or hands in grip of the handle, and may in addition give audible warning if change or relaxation takes place. One or more elements with hook-ended threads may be incorporated with the handle, for example as a cover or hand-grip for the handle, or may be incorporated with the one or more gloves. Whichever item has the hook-ended threads, the other, handle or glove, will incorporate threads for engagement with them; more especially, these latter threads may be upstanding with loop- or eye-ends for ready engagement with the hooks.

The handle may be the handle of a golf or other club (for example, a baseball club), or the handle of a bat or racquet (for example a cricket bat or tennis racquet). Although especially applicable to sports training, the invention is not limited to this.

According to an additional aspect of the invention there is provided a club, bat or racquet having a handle which incorporates or is otherwise provided with an element of fabric fastener for establishing selectively-releasable adhesion with fabric attached byway of glove or otherwise to a user's gripping hand or hands.

According to a further aspect of the present invention there is provided a glove or pair of gloves for use in gripping a handle of a club, bat or racquet, wherein the glove or each glove of the pair incorporates one or more elements of fabric fastener for establishing selectively-releasable adhesion with fabric attached to the handle.

BRIEF DESCRIPTION OF THE DRAWINGS

A method together with a golf club and alternative pairs of golf gloves for use in the method, all in accordance with the present invention, will now be described, by way of example, with reference to the accompanying drawings, in which.

DETAILED DESCRIPTION OF THE INVENTION

Figure 1:
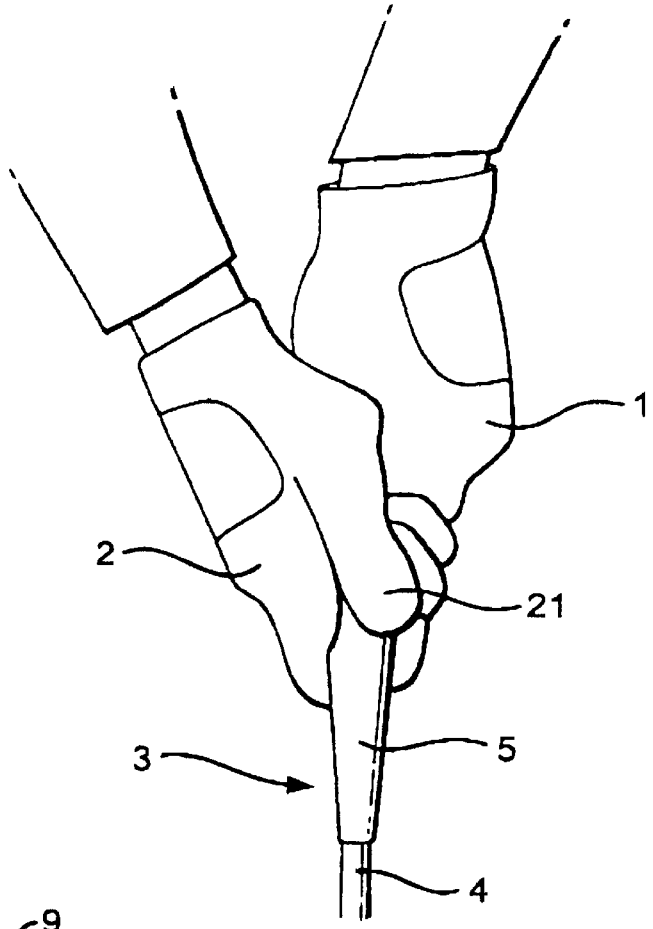
FIG. 1 illustrates application of the golf club (shown only in part) and a first of the pairs of golf gloves, in the method of the present invention.

Referring to FIG. 1, the golfer in the present example wears left and right golf gloves 1 and 2, and holds the frusto-conical handle 3 above the shaft 4 of the golf club in a conventional right-handed grip. The handle 3 has a fabric covering provided by an element 5 that facilitates establishment and maintenance of this grip. The form of the element 5 as this is applied to the handle 3 is shown in FIG. 2.

Figure 2:
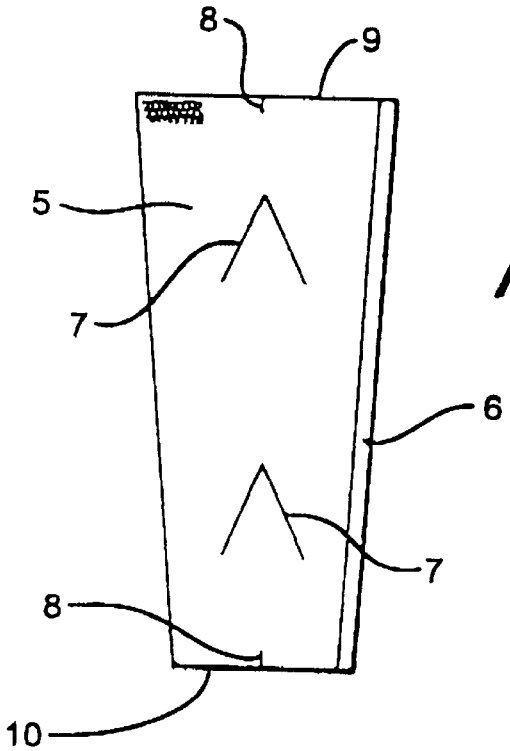
FIG. 2 is illustrative of a fabric element for covering the handle of the golf club used in the method illustrated in FIG. 1.

Referring to FIG. 2, the element 5 is of nylon fabric having upstanding hook-ended threads (represented in one corner only in the drawing), being in this regard one of the two elements of a fabric fastening sold under the Registered Trade Mark VELCRO. The element 5, which has an adhesive backing, is of elongate trapezoidal shape to enable it to be wrapped neatly round the frusto-conical handle 3 with overlap along one longitudinal margin 6 that is free of the upstanding threads.

Arrow markings 7 are provided on the element 5 to assist the golfer in location of his/her grip in relation to the head of the golf club. Small cuts 8 in the top and bottom edges 9 and 10 of the element 5 assist in achieving correct alignment of these markings 7 with the head, during the wrapping of the element 5 round the handle 3.

The second, cooperating element of the fabric fastening in this case is of nylon fabric having upstanding loop- or eye-ended threads for engagement with the hook-ended threads of the element 5. More particularly, and as illustrated in FIGS. 3 and 4, the loop-ended fabric for engagement with the element 5 is divided into four elements 11 to 14 which are attached by their adhesive backings to the front or palmar faces of the gloves 1 and 2.

Figure 4:
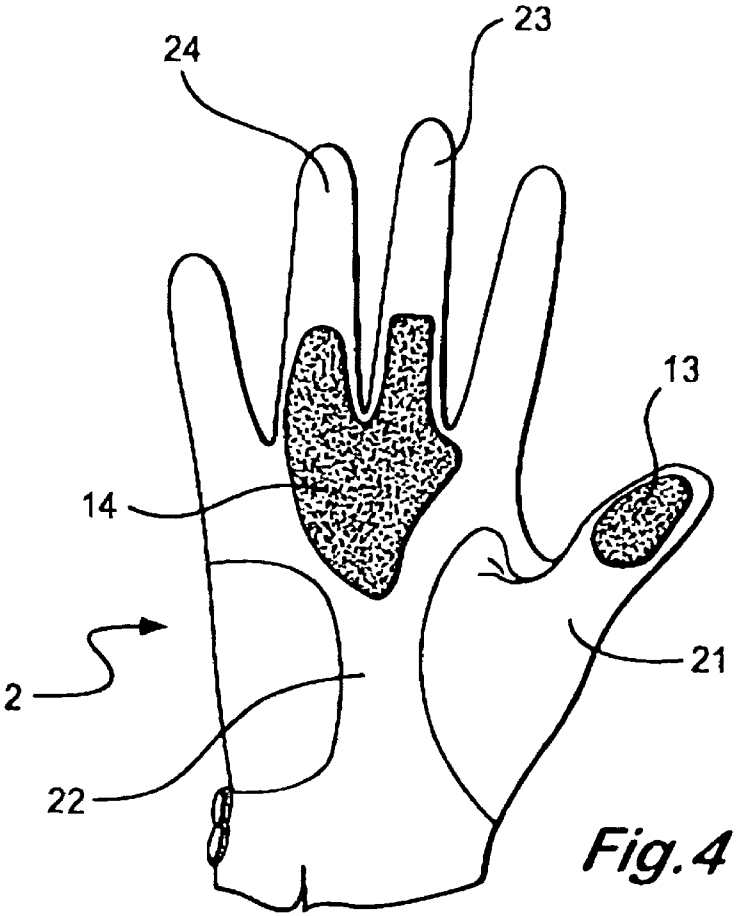
FIGS. 3 and 4 show, respectively, left and right gloves of the first pair of golf gloves according to the invention, used in the method illustrated in FIG. 1.
Figure 3:
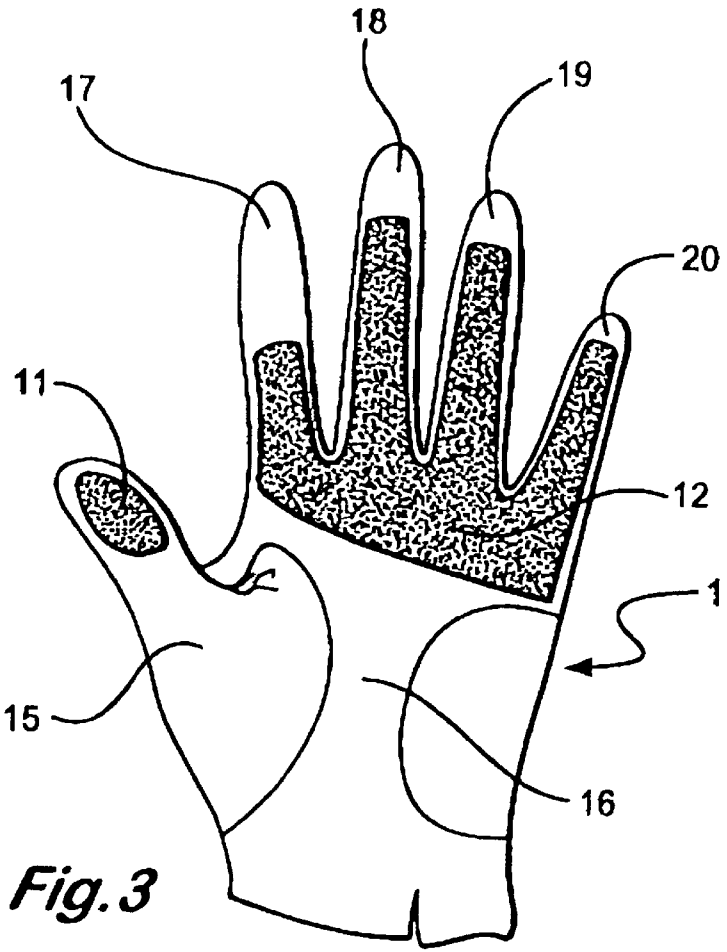

Referring to FIGS. 3 and 4, the gloves 1 and 2 are of conventional form for golf apart from the attached fabric elements 11 to 14. The element 11 covers the distal ball or tip of the thumb 15 of the glove 1, whereas the element 12 extends across the palm 16 of glove 1 at the base of its four fingers 17 to 20 and from there half-way up the first finger 17 and to the tips of the second to fourth fingers 18 to 20. The element 13 on the other glove 2 covers the distal ball or tip of the right thumb 21, whereas the element 14 extends from above the centre of the palm 22 of the right glove 2 to almost half-way up its second and third fingers 23 and 24.

The distribution of the elements 11 to 14 and the areas of the gloves 1 and 2 covered by them, correspond generally to the distribution and areas of contact of the gloved hands with the element 5 when the handle 3 is being gripped appropriately. More particularly, with the conventional right-handed grip illustrated in FIG. 1, the handle 3 lies across the palm 16 of the left glove 1 at the base of the fingers 17 to 20 where covered by the element 12, with the thumb 15 extended downwardly over the upper marking 7, in line with the club-shaft 4 towards the club-head. The thumb 15 presses onto the handle 3 through the element 11, and the fingers 17 to 20 as covered by the element 12 are closed over the handle 3 onto the palm 16 to retain the handle 3 within the grip of the left hand. The gloved right hand partly overlaps the left glove 1 with portions of the fingers 23 and 24 and palm 22 bearing on the handle 3 through the element. 14, and with the thumb 21 (aligned with lower marking 7) extended downwardly pressed onto the handle 3 through the element 13.

Accordingly, there is abutment, and consequently hook-to-loop adhesion, between the individual elements 11 to 14 and the element 5 when the handle 3 is gripped in this way. The adhesion acts to hold the gloved hands firmly to the handle 3 in the established grip. Any breaking of the adhesion with the element 5 at any of the elements 11 to 14 requires a conscious effort and is accompanied by a tearing sound. Thus, if during the swing of the golf club in driving the ball or making any other shot, there is change or relaxation of the established grip, this will be accompanied by a tearing sound readily audible to the golfer. Even if the golfer is not conscious of the effort required by his/her hands to make the change or relaxation, he/she will be aware of the sound made.

The adhesion between the individual elements 11 to 14 and the element 5 to resist relaxation and change of grip provides a restraint useful for training purposes. This, together with the tell-tale sound that accompanies any such relaxation and change of grip, is of considerable assistance to the golfer for improving his/her game. A corresponding advantage can in general be realised in application of the present invention to other sports and circumstances where the grip of a handle is important.

Figure 5:
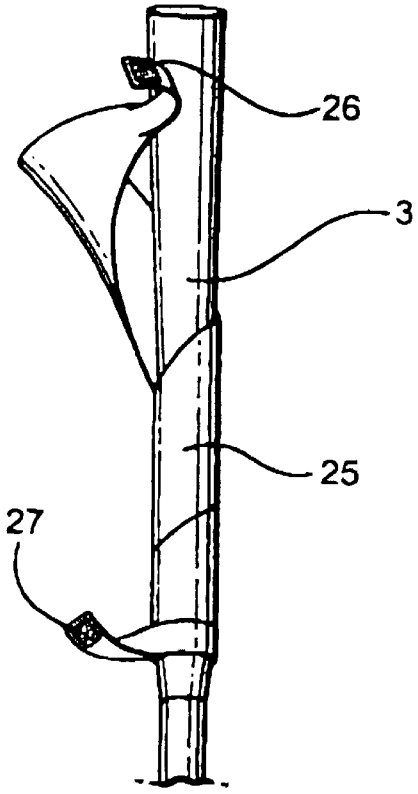
FIG. 5 is illustrative of an alternative form of covering for the handle of the golf club of FIG. 1.
Figure 9:
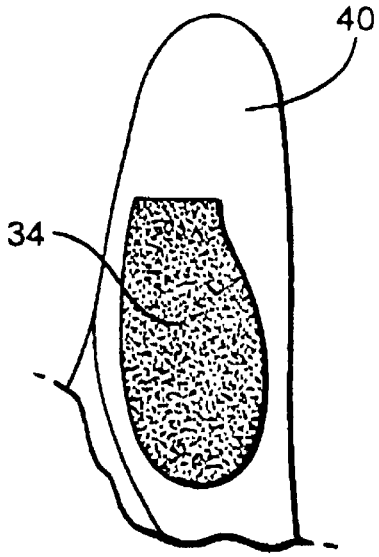
FIGS. 8 to 10 illustrate details of the gloves of FIGS. 6 and 7, FIGS. 8 and 9 being scrap views in the directions of the arrows VIII and IX respectively of FIG. 6, and FIG. 10 being a scrap view in the direction of the arrow X of FIG. 7.
Figure 8:
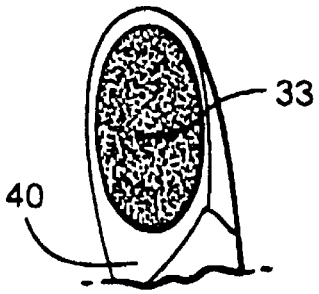

In the example described above, the fabric element 5 is wrapped round the handle 3 to overlap along the margin 6 longitudinally of the club. The longitudinal overlap can be avoided as illustrated in FIG. 5 by means of an element 25 of the hook-ended nylon fabric, that is wrapped helically and tightly butting onto itself, round the handle 3. The element 25 is secured in place at both ends using fabric fastening between its outer surface and wrap-over tabs 26 and 27 of loop-ended threads on its inner surface. As an alternative, the element 5 may be replaced by a tubular moulding which has the necessary fabric-fastener element as its outer, and which fits onto the shaft 4 in the way of a conventional replacement handle for golf clubs.

Although the gloves 1 and 2 in the above example have added elements 11 to 14 to provide for adhesion with the club-handle 3, it may be unnecessary in certain circumstances to provide more than one glove with such fabric. However, a pair of gloves which may be used as an alternative to the gloves of FIGS. 3 and 4, and which incorporates a preferred disposition of discrete 'adhesion'-fabric elements, is illustrated in FIGS. 6 to 10 and will now be described.

Figure 7:
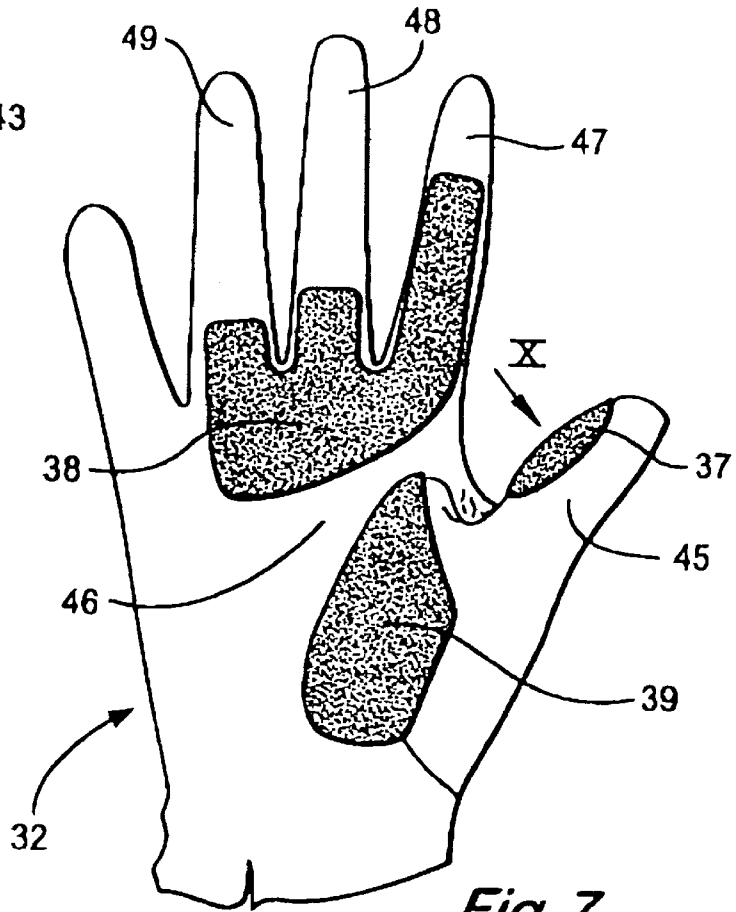
FIGS. 6 and 7 show, respectively, left and right gloves of the second pair of golf gloves according to the invention, used in the method illustrated in FIG. 1.
Figure 6:
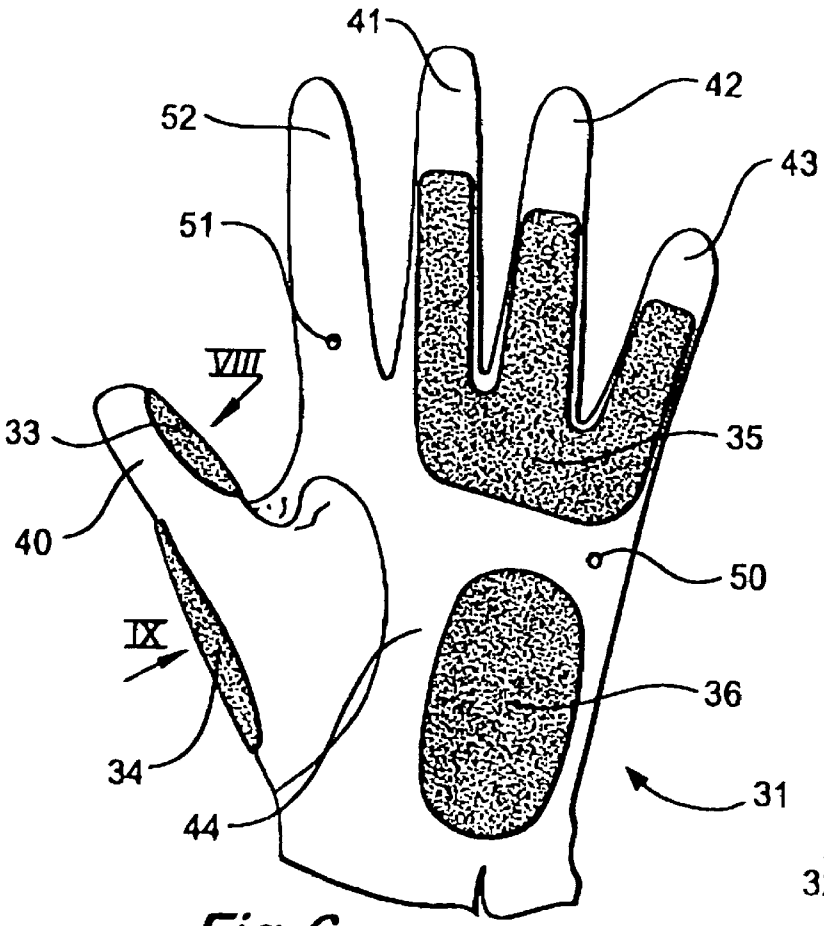

Referring to FIGS. 6 and 7, the left and right golf gloves 31 and 32 in this case, have respective groups of attached fabric elements 33 to 36 and 37 to 39. The elements 33 and 34, as shown in FIG. 6, are attached to the thumb 40 of the left glove 31, the element 33, as illustrated more clearly in FIG. 8, covering the distal ball or tip of the thumb 40, whereas the element 34, as illustrated more clearly in FIG. 9, covers the back of the thumb 40 onto the knuckle. The element 35 extends part way up, and across the base of, the second to fourth fingers 41 to 43 of the glove 31, whereas the element 36 extends along the ulnar side of the palm 44 of that glove.

Figure 10:
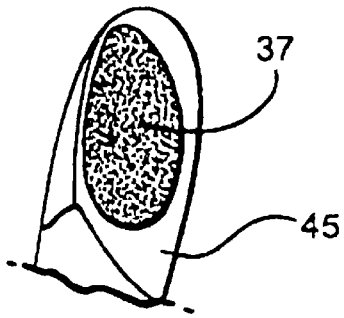

As shown in FIG. 7, the element 37 is attached to the thumb 45 of the right glove 32, being attached as shown in FIG. 10, to the distal ball or tip of the thumb 45. The element 38 extends slightly onto the palm 46 of the glove 32 and up to almost the tip of its first finger 47, but only slightly onto its second and third fingers 48 and 49, from across the base of the fingers 47 to 49, whereas the element 39 extends from the radial side of the palm 46 onto the base of the thumb 45.

The elements 33 and 35 to 37 have loop-end threads and their distribution on the two gloves 31 and 32 ensures that when the handle 3, covered (for example, as described above with reference to FIG. 2 or FIG. 5) with fabric 5 or 25 having hook-ended threads, is gripped appropriately, there is optimum retention of that grip throughout swing of the club. In taking up the conventional right-handed grip of the handle 3, the handle 3 is placed across the palm of the left hand as that hand is closed round the handle 3, and the right hand is then closed onto the handle 3 with the base of its thumb overlying the back of the thumb of the left hand. Accordingly, as the grip is established wearing the gloves 31 and 32, the fabric elements 35 and 36 and then the element 33 of the left glove 31, adhere to the fabric-covered handle 3, followed by adhesion to the handle 3 of the fabric elements 37 and 38 of the right glove 32. Thus, as with the gloves 1 and 2 of FIGS. 3 and 4, the gloves 31 and 32 afford adhesion between the gripping hands and the golf club to provide a restraint useful for training purposes. However, the gloves 31 and 32 incorporate further features that are of advantage in training.

In the latter respect, the fabric element 34 and 39 are of opposite thread types; for example, the element 34 has hook-ended threads whereas the threads of the element 39 are loop-ended. Accordingly, there is adhesion between the elements 34 and 39 where the right glove 32 overlies the left glove 31, so that with the gloves 31 and 32 there is the added advantage that relaxation of the right hand from the left hand is opposed as further restraint on change of the established grip.

Holes 50 and 51 in the left glove 31, as shown in FIG. 6, provide a further feature that is of advantage for training purposes. More particularly, the holes 50 and 51 define an optimum line of alignment for the handle 3, extending from the hole 51 just above the base of the first finger 52 of the glove 31 and across the palm 44 to the hole 50 just below the fourth finger 43. Accordingly, in taking up the conventional right-handed grip, the handle 3 is first located in register with the holes 50 and 51 so that it has the correct positioning within the hands for achieving optimum grip.

It will be appreciated that in the above examples described with reference to the drawings, it may be the elements 11 to 14, 33 and 35 to 39 that have the hook-ended threads rather than the elements 5, 25 and 34. In this case, the threads of the elements 5, 25 and 34 will be loop-ended or of any other form suitable to be engaged adhesively by the hook-ended threads.

Furthermore, it has been assumed above in connection with FIGS. 1, 3, 4, 6 and 7 that the invention is used to assist a right-handed golfer using a conventional grip of the club-handle 3, but it will be apparent that the invention is equally applicable to circumstances where the golfer is left-handed and where any grip, conventional or unconventional, is used. The distribution and areas of the gloves 1 and 2, or 31 and 32, covered by fabric elements with relevant hook- or loop-ended threads, merely requires adaptation to the handedness of the golfer and the grip used.

What is claimed is:

1. A pair of golf gloves for one of restraining relaxation and change of a user's grip of a golf-club handle, wherein a first glove incorporates a palm, fingers that have a common base region connecting them to the palm, and an element of a first fabric for mutual adhesion with an element of a second fabric incorporated with the handle, the mutual adhesion resulting from selectively-breakable engagement between hook-ended threads of one of the two fabrics and threads of the other, the element incorporated with the first glove is a discrete element comprising a plurality of elongate portions of the first fabric which extend lengthwise at least part way along respective fingers of the first glove, and a strip portion of the first fabric integral with the finger-portions, the strip portion interconnecting the finger-portions and having a configuration confining it to solely within the base region of the fingers of the first glove, and wherein one of the gloves of the pair incorporates a fabric element having hook-ended threads for selectively-breakable engagement with threads of a fabric element incorporated with the other glove of the pair such that there is mutual adhesion between the two gloves for one of restraint of relaxation and change of the interrelationship of the hands in gripping the handle.

2. The pair of golf gloves according to claim 1, wherein the second glove incorporates at least one discrete element of the first fabric for selectively-releasable adhesion to the covered-handle.

3. The pair of golf gloves according to claim 2, wherein an element of the first fabric is attached to a front of the second glove to extend across it within a base region of a plurality of its fingers.

4. The pair of golf gloves according to claim 3, wherein the element of the first fabric attached to the front of the second glove, extends across the base region of the second and third fingers of that glove.

5. The pair of golf gloves according to claim 2, wherein an element of the first fabric is attached to a distal ball of a thumb of the second glove.

6. The pair of golf gloves according to claim 1, wherein the first glove incorporates a fabric element on the back of a thumb of the first glove, and the second glove incorporates a cooperating fabric element for selectively-breakable engagement with the fabric element on the back of the thumb of the first glove, the cooperating fabric element extending from the radial side of a palm of the second glove onto a base of a thumb of the second glove.

7. The pair of gloves according to claim 1, wherein the second glove incorporates a discrete element of the first fabric that extends at least partly along a first finger of the second glove.

8. The pair of gloves according to claim 1, wherein the first glove has a plurality of holes therein for defining a line of alignment for grip of the golf-club handle, a first of the holes being located in the first finger of the fingers of the first glove, and a second of the holes being located in the palm below the fourth finger of the fingers of the first glove.

9. In combination, a handle to be gripped by a user, and a glove for wear by the user in gripping the handle, wherein the glove incorporates a palm, a thumb, fingers that have a base region connecting them to the palm, and first and second discrete elements of a first fabric, and the handle incorporates an element of a second fabric for mutual adhesion with the element of first fabric, the mutual adhesion resulting from selectively-breakable engagement between hook-ended threads of one of the fabrics and threads of the other, and wherein the first discrete element of fabric incorporated with the glove comprises a plurality of elongate finger-portions of the first fabric which extend lengthwise at least part way along respective fingers of the glove, and a strip portion of the first-fabric integral with the finger-portions, the strip portion interconnecting the finger-portions and having a configuration confining it to solely within the base region of the fingers of the glove, and wherein the second discrete element of fabric incorporated with the glove comprises an element of the first fabric attached to a distal ball of the thumb of the glove.

10. The combination according to claim 9, wherein the second fabric has a multiplicity of upstanding hook-ended threads and the first fabric has a multiplicity of loop-ended threads for selectively-breakable engagement with the hook-ended threads.

11. The combination according to claim 9, wherein breaking of the engagement is audible to provide one of an indication of relaxation and a change of the grip.

12. The combination according to claim 9, wherein the handle is the handle of a golf club.

13. The golf glove according to claim 9, wherein a further element of the first fabric is attached to an ulnar side of the palm of the glove.

14. In combination, a handle to be gripped by a user, and a glove for wear by the user in gripping the handle, wherein the glove incorporates a palm, fingers that have a base region connecting them to the palm, and first and second discrete elements of a first fabric, and the handle incorporates an element of a second fabric for mutual adhesion with the element of first fabric, the mutual adhesion resulting from selectively-breakable engagement between hook-ended threads of one of the fabrics and threads of the other, and wherein the first discrete element of fabric incorporated with the glove comprises a plurality of elongate finger-portions of the first fabric which extend lengthwise at least part way along respective fingers of the glove, and a strip portion of the first fabric integral with the finger-portions, the strip portion interconnecting the finger-portions and having a configuration confining it to solely within the base region of the fingers of the glove, and wherein the second discrete element of fabric incorporated with the glove comprises an element of the first fabric attached to an ulnar side of the palm of the glove for mutual adhesion with the element of second fabric incorporated with the handle.

15. The golf glove according to claim 14, wherein the strip portion extends across the glove in the base region interconnecting only the second to fourth fingers of the fingers of the glove.

16. The golf glove according to claim 14, wherein an element of the first fabric is attached to a distal ball of a thumb of the glove.

17. The combination according to claim 14, wherein the handle is the handle of a golf club, and wherein the glove has a plurality of holes therein for defining a line of alignment for grip of the handle, a first of the holes being located in the first finger of the fingers of the glove, and a second of the holes being located in the palm below the fourth finger of the fingers of the glove.

* * * * *